United States Patent [19]

McPherson

[11] 4,210,195

[45] Jul. 1, 1980

[54] METHOD OF TREATING CAST IRON USING PACKAGED GRANULAR MOLTEN METAL TREATMENT MOLD INSERTS

[75] Inventor: James C. McPherson, Ypsilanti, Mich.

[73] Assignee: Ford Motor Company, Dearborn, Mich.

[21] Appl. No.: 968,945

[22] Filed: Dec. 13, 1978

[51] Int. Cl.[2] ..... B22D 23/00; B22D 25/00; B22D 27/20

[52] U.S. Cl. ..... 164/57; 75/130 R; 75/130 B; 164/55

[58] Field of Search ..... 164/55, 57, 56, 58; 75/130 R, 130 A, 130 B, 53

[56] References Cited

U.S. PATENT DOCUMENTS

| | | | |
|---|---|---|---|
| 3,605,857 | 9/1971 | Duhem | 164/55 X |
| 4,004,630 | 1/1977 | Dunks | 164/57 |
| 4,037,643 | 7/1977 | Mohla et al. | 164/57 X |

FOREIGN PATENT DOCUMENTS

| | | | |
|---|---|---|---|
| 2807048 | 8/1978 | Fed. Rep. of Germany | 164/57 |

*Primary Examiner*—Robert D. Baldwin
*Assistant Examiner*—Gus T. Hampilos
*Attorney, Agent, or Firm*—Joseph W. Malleck; Keith L. Zerschling

[57] ABSTRACT

A method of treating molten cast iron is disclosed, wherein a sand mold is formed with a gating system, a plurality of casting cavities, and treating chambers all located symmetrically about a parting plane of said mold. The treating chamber is interposed in the gating system and is configured to receive a predetermined sized module of treating alloy arranged to fit snuggly within a predetermined size lower portion of said chamber. The module is comprised of fiberboard folded into a closed container condition and filled with granular treating alloy particularly comprised of nominally 5% MgFeSi. The molten metal reacts progressively from the top of said module to the bottom portion thereof as the molten metal flows over and therepast. The fiberboard enclosed granules constitute a convenient, economical and improved mode for treating molten cast iron particularly when nodularization is required, and particularly with restrictions such as those imposed by the shall mold technique wherein the centerline of the reaction chamber coincides with the parting line of the mold. Due to differential ferrostatic head heights during mold filling there is a radical variation in flow rate through the treatment chamber. These conditions necessitate the use of a granular material with a tendency to more immediately react with the molten metal than a cast-to-shape or briquetted material. The granular material is enclosed in the module of sufficient integrity to hold a cubicle configuration extending across the plating plane, allowing the mold halves to be closed.

6 Claims, 5 Drawing Figures

METHOD OF TREATING CAST IRON USING PACKAGED GRANULAR MOLTEN METAL TREATMENT MOLD INSERTS

BACKGROUND OF THE INVENTION

Graphitizing inoculation for grey iron and spheroidizing treatment for ductile iron can both be carried out by adding the alloy inside the mold rather than in the ladle. This process can yield considerable qualitative, economical and ecological advantages. Among the most important are: the absence of fading of the spheroidizing effect, the automation of pouring, the suppression of slagging, the elimination of smoke and glare during the spheroidizing treatment, and the suppression of pouring residue pigging.

Conversely, some problems must be adequately solved as regards the alloy chamber design and alloy form to achieve a uniform solution rate, the necessity to limit the tendency to formation of inclusions in the castings, and finally the development of a quality control to assure consistency of good castings.

The in-the-mold treatment is currently commercially carried out by measuring a predetermined quantity of granulated spheroidizing alloy. The granular material is relatively economical, typically being a crushed form of a cast sheet of ferromagnesium. The granular material is metered by a measuring cup and poured into the treating chamber of the open mold. The material tends to form a mound with a network of air spaces between the piled granules; some of the granules may be displaced and carried with the flow of molten metal after pouring is started. This leads to inclusions in the castings and disturbs the intended solution rate of the alloy which must uniformly contact the entire body of molten metal as it flows through the treating chamber. (See U.S. Pat. No. 3,703,922 for a complete teaching of this granulated method).

The granular method (even when the granules are briquetted) does not assure consistent dissolution in the different phases of the pouring. The alloy granules are cold at first, then heat up rapidly. The dissolution rate rises, then quickly continues to a maximum value and afterwards decreases because the alloy mass surface has also decreased rapidly.

One attempt to solve these problems, particularly by the assignee herein, consists of forming the alloy of an impervious cast-to-shape block which is inserted into a snuggly fitting treating chamber; the walls of the cast-to-shape block fit tightly against the treating chamber walls at the sides as well as the bottom, exposing only the upper surface to confront the molten metal; this is to achieve a greater consistency of dissolution throughout the entire treatment. However, the inability to ignite the block and heat it to a dissolution temperature has caused the initial phase of the treatment to be off target and in many cases has permitted the treatment to be inadequate.

In every case, the dissolution rate depends upon the surface exposed to the metal flow, which in itself varies greatly. It follows that the inoculation action cannot be a constant during the casting procedure. Moreover, with each of these methods, either cast-to-shape or granulated, there is a need for automating the process so that it can lend itself to greater quality control. For example, too often, particularly with granular material, there is dispensed an inadequate amount of material in the treating chamber because individual attention may not be consistent. With the cast-to-shape block, cost is significantly high because of the custom shaping.

Accordingly, what is needed is an economical approach to an alloy module which not only promotes instant ignition of the treating alloy so that it may go instantly into solution at the beginning of the pour, a module which is extremely economical to prepare and has long shelf life so that it may be used with greater assurity, and one which adequately treats all the metal which passes through the treatment chamber through the flow rate may vary considerably.

SUMMARY OF THE INVENTION

A primary object of this invention is to provide an improved method for spheroidizing or nodularizing cast iron which method is characterized by greater economy of costs, improved solution control of the alloy into the molten metal, and instantaneous reaction at the very start of the treatment.

Another object of this invention is to provide a module which promotes an improved method for nodularizing cast iron, the module permitting the method to be carried out by a machine and thereby promote greater automation.

Features pursuant to the above objects comprise: (a) the formation of a thin guage fiberboard foldable box which can be defined from a single blank or sheet material, the box, when folded, forming a three dimensional shell for enclosing granulated alloy material which fills the box; (b) protects the alloy during storage prior to use, and (c) assures the proper addition is made to every mold.

DETAILED DESCRIPTION

Figure 3:
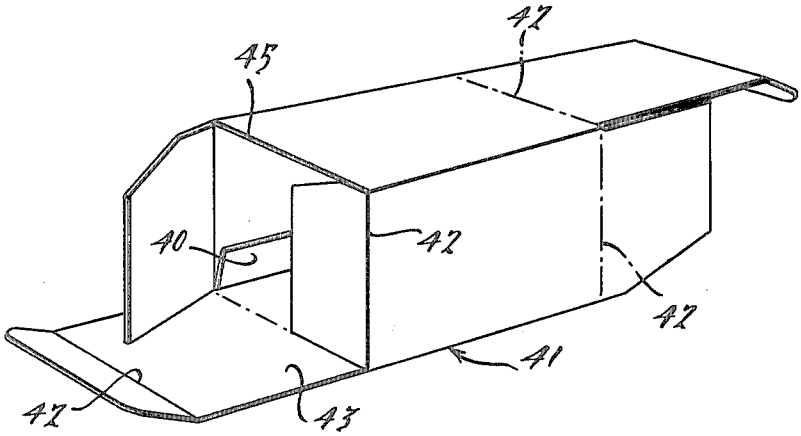
FIG. 3 is an enlarged perspective view of an unfilled module container used in FIGS. 1 and 2.
Figure 1:
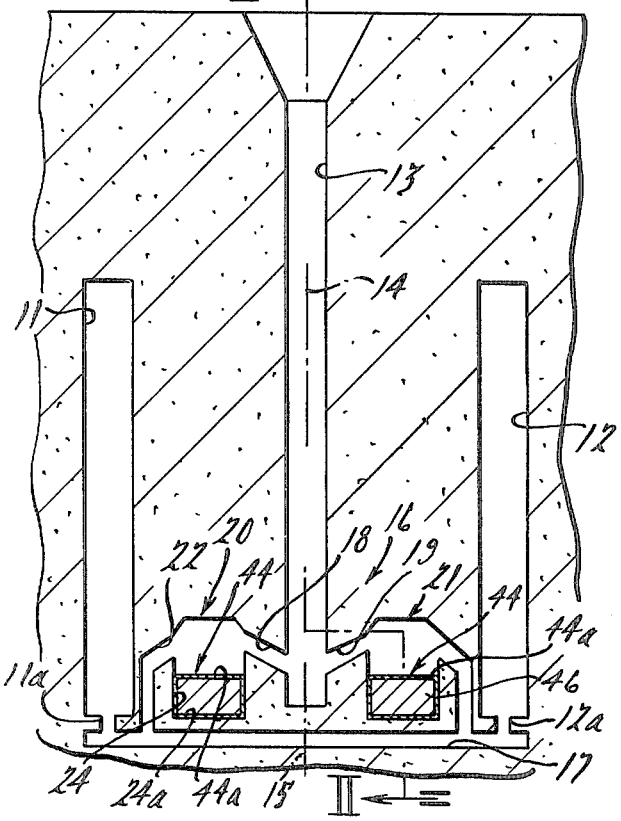
FIG. 1 is central sectional elevational view of a casting mold employing an alloy treating module according to the principles of this invention.
Figure 2:
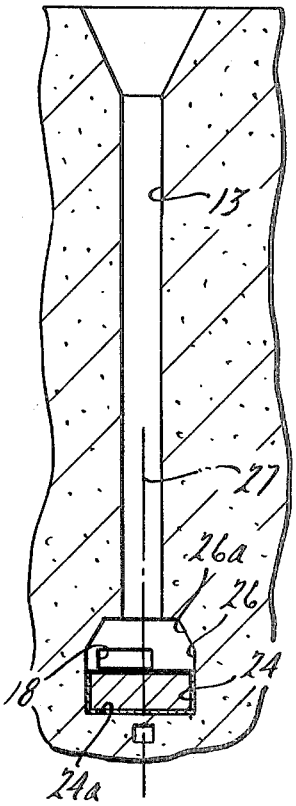
FIG. 2 is a sectional view taken along line 1—1 of FIG. 1.
Figure 4:
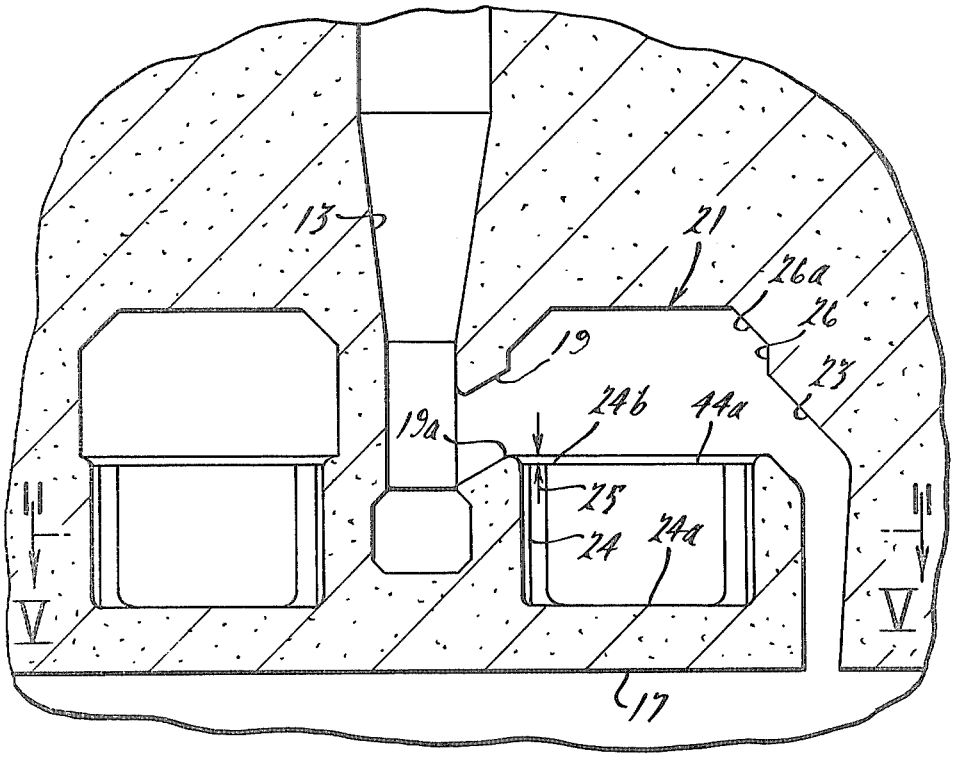
FIG. 4 is an enlarged fragmentary view of FIG. 2.
Figure 5:
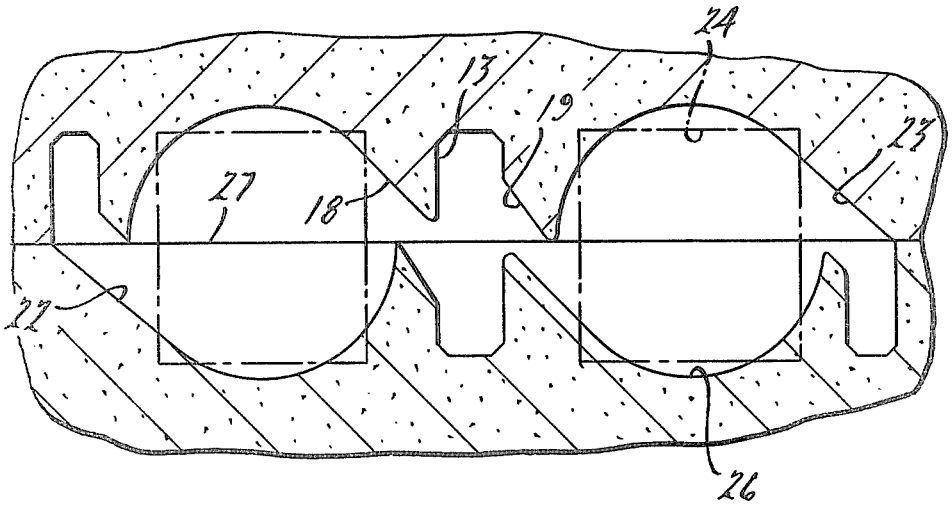
FIG. 5 is a view taken along 5—5 of FIG. 4.

To achieve adequate dissolution of the treating agent, greater economy of processing, and more controlled start-up reaction, the following preferred method is employed.

(1) A sand mold 10 is prepared with a plurality of casting cavities 11, 12 fed by common sprue 13 (which is round in its upper portion and merges into a lower rectangular section), having an axis 14 aligned with a centerline 15 between said cavities. A gating system 16 interconnects the sprue 13 and a horizontal runner 17, the latter feeding the cavities from the bottom. The gating system has passages 18, 19 (with rectangular cross-sections) extending oppositely and upwardly from the sprue 13; each passage (18,19) connects respectively with a treating chamber (20,21), which in turn has passages 22, 23 respectively exiting downwardly and outwardly from the treating chamber to connect with runner 17 at a location adjacent the entrances 11*a*, 12*a*, respectively, to the cavities. Each treating chamber has a depending portion 24 shaped as a cubicle or rectangular basin with a flat bottom 24*a*; the upper extremity 24*b* of the cubicle is located slightly below the lower edge 19a of the gating passage 19 (or in the alternative 18a of passage 18), the distance 25 being no greater than ⅜ inch. The upper portion 26 of each treating chamber forms a swirl dome and has an annular side wall which is closed at the top by a truncated cone 26a serving to direct flow in a circulatory manner into, through and out of the treating chamber. The sprue, gating system, treating chambers, runner and cavities are arranged symmetrically about a central mold parting plane 27. This is necessitated by the shell molding technique (known in the art) and requires that any insertable elements into the treating chamber must be of a sufficient integrity to project out of half of the mold when in position.

(2) A fiberboard flat blank 43 is cut or trimmed to a desired configuration (see FIG. 3) with tab 40 adapted to be brought around and adhered (such as by gluing) to an opposite edge of the blank, forming an opened-ended cylinder 41. Crease lines 42 are imprinted upon the blank, permitting predetermined folding to form a closed module or container 44 from the cylinder. The guage or thickness of the fiberboard should be 0.015", and the fiberboard content should be free of clay coating, permitting instant ignitability upon contact with molten metal.

(3) The module or container 44 has the interior thereof fully filled with a granular treating alloy 46. This, of course, is conveniently accomplished by folding and closing one end of the module with the other end unfolded and unclosed. The granular material is poured into the interior of the module until the top of the granular material is even with the upper edge 45. This step can be automated and the addition can be metered and weight checked. The treating alloy is typically comprised of ferromagnesium silicon, typically consisting of 5.5–7.0% Mg, 0.45% Ce, 43–48.0% Si, 1.0–1.6% Ca. Said alloy is prepared by preparing a melt of the chemical ingredients, typically in an electric induction furnace, pouring said melted alloy into a flat bed chill mold, dumping the contents of the mold when solidified onto a conveyor belt (the thickness of the sheet within the mold being approximately 1" or less) and processing the solidified flat sheets through a milling machine to form particles which can be screened to a size of 6×20 mesh.

(4) The fully filled modular container is then placed into the sand mold 10, the latter being in the opened condition, so that the fiberboard container fits snuggly against the side walls 24 and bottom 24a of the lower portion of the treating chamber in one mold part. There should be little or no air gap between the sides of the module and the side walls of the sand treating chamber. The only surface of the module that is exposed is that of the upper top 44a. The other mold part is brought into mating position with the first part, closing the mold and causing contact of the mold treating chamber with the remaining sides and bottom of the module.

(5) Molten cast iron is introduced to the mold 10 after it is brought into its closed condition with both parts fully mated along the parting plane 27. The molten cast iron finds its path through the gating system and to the treating chamber where the exposed upper section 44a of the fiberboard module is caused to disintegrate and be displaced by molten metal. The thickness of the top portion of the fiberboard module is easily disintegrated and displaced by molten metal which in turn reacts progressively with the treating agent, working downwardly from the top toward the bottom thereof.

To insure that the treating agent is heated to a reactive temperature in preparation for its dissolution upon contact with the molten metal, the sides of the fiberboard box may in some instances be disintegrated at the first instance of the molten metal entering the treating chamber whereby a thin sliver of molten metal displaces the thickness of the fiberboard box along the sides thereof to warm the granular material adjacent thereto. This facilitates a quicker and instantaneous firing of the treating agent at the very beginning of the pour so that all of the molten metal, both from the instant of the pour to the end, will obtain a sufficient degree of treatment.

Ignition tests have shown that sample fiberboard containers with original weights of 0.285 and 0.238 oz. have left residual ash material weighting 0.010 and 0.008 oz. respectively. This ash is easily captured in the swirl dome located directly over the treatment chamber and has not been found to have any deleterious effects on the castings.

I claim:

1. A method of treatng molten cast iron with a highly reactive and volatile treating agent, comprising:

(a) forming a mold having a casting cavity and a gating system, said gating system having side and bottom walls extending from one location of said gating system to define a treating chamber, the gating system providing an entrance to and an exit from said chamber each adjacent the upper portion of the chamber;

(b) folding a flat thin-guaged fiberboard blank into a module having a configuration effective to form a total enclosure and to fit snuggly within the lower portion of said treating chamber with no air gap between the side and bottom walls thereof;

(c) fully filling the interior of said module with a selected granular highly reactive and volatile treating agent;

(d) placing said filled module into snug fitting reltionship with at least the lower portion of said treating chamber including side walls and bottom wall; and (e) introducing a predetermined quantity of molten cast iron into said gating system and thereby into said treating chamber, whereby the agent is preheated by metal which displaces, by disintegration, the side walls of said module and the exposed upper section of said fiberboard module is caused to disintegrate and be displaced by molten metal, which molten metal in turn reacts progressively with the treating agent from the top to the bottom of the module.

2. The method as in claim 1, in which in step (d) said granular treating agent is particularly comprised of crushed and sized magnesium ferro-silicon containing 5% magnesium.

3. The method as in claim 1, in which the lower portion of said treating chamber is configured to be a cubicle with the bottom and sides thereof each having dimensions predetermined to hold the proper amount of treatment agent to condition all of the molten metal passing through the treatment cavity.

4. The method as in claim 1, in which said mold is arranged in two parts, the parting plane of said mold dividing the gating system and cavities as well as treating chamber in two portions symmetrical about said parting plane.

5. The method as in claim 1, in which the gating system is arranged in step (a) so that molten metal introduced in step (e) enters said treating chamber at a distance no greater than $\frac{3}{8}$ inch above the flat top surface of said module.

6. The method as in claim 1, in which the upper portion of said treating chamber in step (a) is defined to have a truncated conical configuration effective to circulate molten metal introduced thereto along the outer walls thereof and to serve as an expansion space for gas generated during the reaction within said treating chamber, and also a trap for the by-products of the reaction and the combustion of the fiberboard container.

* * * * *